United States Patent [19]

Martin

[11] Patent Number: 5,020,806

[45] Date of Patent: Jun. 4, 1991

[54] MULTIPLE TARGET ELECTRONIC DART GAME

[75] Inventor: John Martin, Rockford, Ill.

[73] Assignee: Arachnid, Inc., Rockford, Ill.

[21] Appl. No.: 509,170

[22] Filed: Apr. 16, 1990

[51] Int. Cl.[5] ..... F41J 1/16; F41J 5/04

[52] U.S. Cl. ..... 273/371; 273/DIG. 28; 273/DIG. 26

[58] Field of Search ..... 273/1 ES, 1 E, 85 G, 273/DIG. 28, 376, 374, 373, 371, DIG. 26

[56] References Cited

U.S. PATENT DOCUMENTS 4,477,069 10/1984 Crudgington ..... 273/85 G
4,572,509 2/1986 Sitrick ..... 273/85 G
4,824,121 4/1989 Beall et al. ..... 273/376

FOREIGN PATENT DOCUMENTS 2153189 8/1985 United Kingdom ..... 273/85 G

*Primary Examiner*—Benjamin Layno
*Attorney, Agent, or Firm*—Leydig, Voit & Mayer

[57] ABSTRACT

A multiple target electronic dart game having shared microprocessor that monitors and services operation of the electronic dart game. The multiple targets are mounted on opposite sides of a column which may be floor-standing or wall mountable. Affixed to the top of the column is visual display video monitor for providing players and observers with game scores and the like. The visual display video monitor is optionally capable of split-screen presentation. The novel design of the multiple target electronic dart game enables players to play dart games not previously available with single target dart games. Moreover, many components utilized by the controls are shared, thus enabling cost savings by eliminating substantial duplication of components.

10 Claims, 1 Drawing Sheet

MULTIPLE TARGET ELECTRONIC DART GAME

FIELD OF THE INVENTION

The present invention relates generally to self-scoring electronic dart games, and more particularly to electronic dart games having multiple targets.

BACKGROUND OF THE INVENTION

Self-scoring electronic target games are known. For example, U.S. Pat. No. 4,793,618 to Tillery et al. discloses an electronic target game adapted for use with a visual display device which is disposed within the viewing region of the game. Such a microprocessor-controlled dart game automatically registers and displays scores attained by players.

The development of microprocessors has made computerized dart games possible. Microprocessors control the operation of the game, including automatically calculating each player's current score. A microprocessor executes instructions stored in a ROM memory chip. The ROM contains instructions for a variety of dart games with different rules and procedures of play.

Present computerized dart games consist of one target controlled by at least one microprocessor. U.S. Pat. No. 4,516,781 to DeVale et al. discloses a dart game with two microprocessors. Although there is only one target in the DeVale patent, two microprocessors are used to monitor and service the dart game. The first microprocessor scans the target to detect where a dart strikes the target, and the second microprocessor performs numerous functions such as totalling the score of each player and actuating indicators which inform the players of the conditions and score of each player.

The controls for a multiple target electronic dart game would have many identical components. It would therefore be possible to avoid duplicating identical components for each control and have the targets share identical components. Such a design would decrease production cost by eliminating duplicate components. Furthermore, a multiple target electronic dart game would also give rise to a host of additional games that are not practical with individual, single target dart games.

OBJECTS AND SUMMARY OF THE INVENTION

Accordingly, it is a primary object of the present invention is to provide a multiple target electronic dart game, which because of its novel design, allows players to participate in dart games which were not previously available with single target dart games.

Another object of the present invention is to reduce the cost for producing electronic dart games. The controls for the multiple target electronic dart games of the present invention share components, thus eliminating the necessity to duplicate many identical components used in constructing the controls.

Other objects, features, and advantages of the invention will be readily apparent from the following description of certain preferred embodiments thereof taken in conjunction with the accompany drawing, although variations and modifications may be effected without departing from the spirit and scope of the novel concepts of the disclosure.

While the invention will be described in connection with the preferred embodiment, there is no intent to limit it to that embodiment. On the contrary, the intent is to cover all its alternatives, modifications and equivalents included within the spirit and scope of the invention as defined by the claims.

DESCRIPTION OF THE PREFERRED EMBODIMENT

Figure 1:
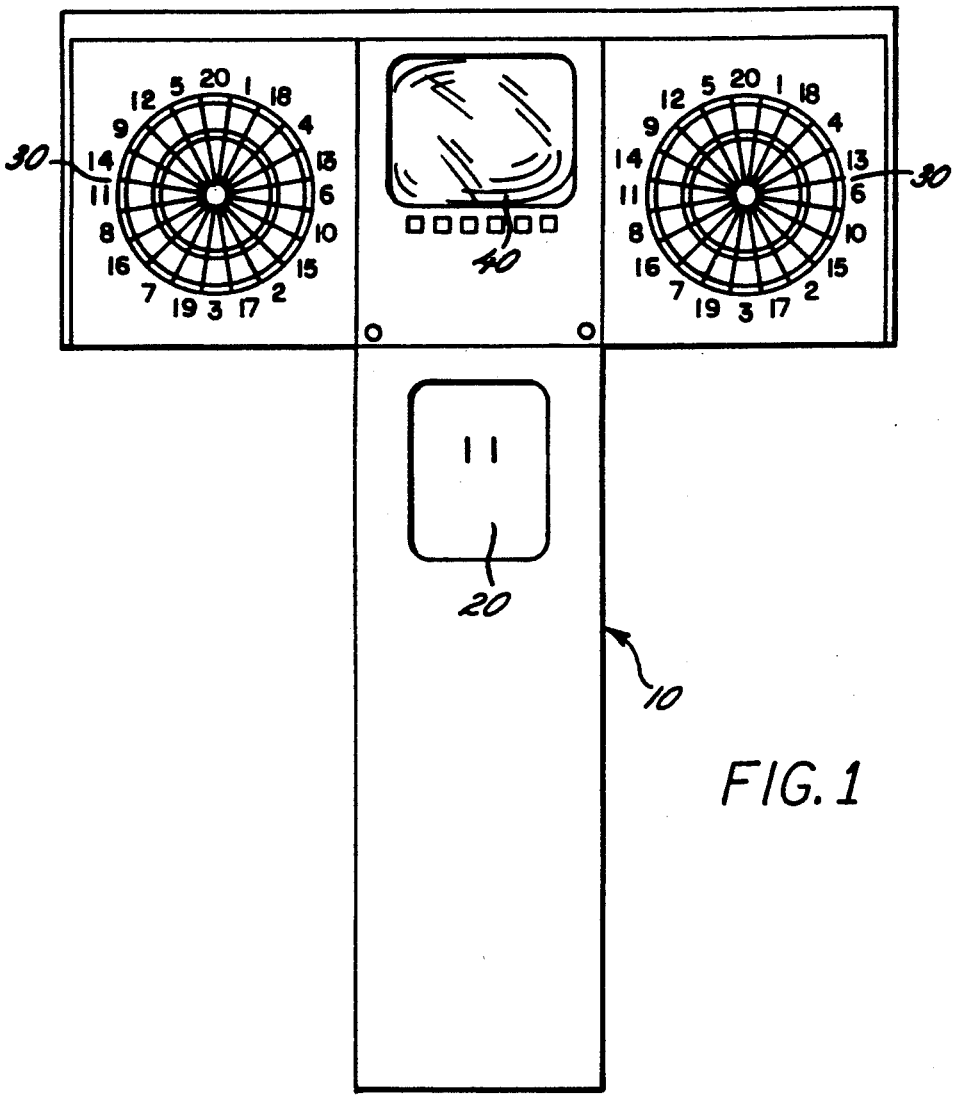
FIG. 1 illustrates a preferred embodiment of the present invention.

Turning now to the drawings, FIG. 1 illustrates a preferred embodiment of the present invention. The preferred embodiment has upright support means in the form of a column 10 which may be secured to a base. It will be appreciated that while the support means is shown as a floor-standing arrangement, it can also be set up for a wall mount, if desired. Targets 30 for darts are located at the top and opposing sides of the column 10.

A visual display means 40 is attached to the top of the column 10. The visual display means 40 is located at the top of the column 10 in order to facilitate viewing by the observers. In the preferred embodiment, the visual display means 40 is a video display which can be capable of split-screen presentation. In other embodiments, the visual display means can be a light-emitting-diode (LED) configuration or a liquid crystal display (LCD).

The player interface 20 is located at the center portion of the column 10. The player interface 20 includes a coin slot mechanism, game selection controls, number of players input selectors, and the like.

The operating system which is housed in the column 10 includes shared processor means 50 (FIG. 2) means that and services the operation of the multiple target electronic dart game, including the functions of both targets 30. Two players can participate simultaneously, each player throwing his darts at one of the targets 30.

Figure 2:
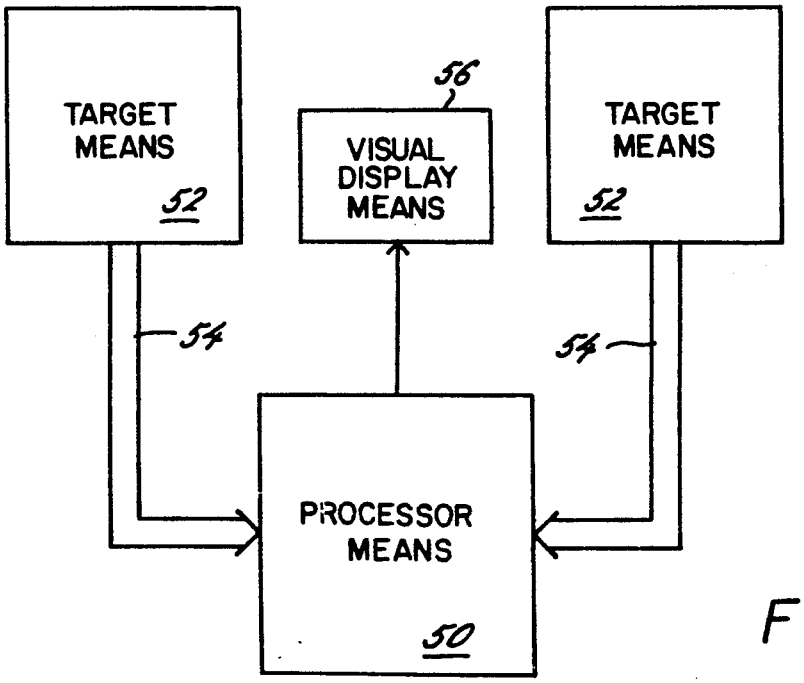
FIG. 2 is a block diagram illustrating how the electrical components of the present invention are interlinked.

FIG. 2 is a block diagram illustrating how the electrical components of the present invention are interlinked. The processor means 50 are connected to multiple target means 52 via multiple data buses 54. The shared processor means 50 simultaneously monitor the target means 52 and present game information on visual display means 56.

The present invention allows for a reduction in the number of components conventionally required to assemble more than one electronic dart game. For example, the microprocessor means located in the column 10 monitors and services both targets 30. Indeed, two microprocessors may be used as in the DeVale patent, wherein one microprocessor monitors dart hits for both targets and another microprocessor services scoring calculations for both targets. Furthermore, the housing normally required for more than one dart game is drastically reduced by an embodiment of the present invention. Accordingly, the novel design of the present invention allows for the elimination of additional duplicate components which are normally required to construct more than one electronic dart game. The present invention allows controls to share components, thus reducing the cost of production.

The visual display means 40 shows players' current scores and the like. The visual display means 40 can present player information in a combined format, or present player information independently in a split-screen format. The visual display means can also use a split-screen format when the players are not interacting with each other.

Players may participate in interactive games, wherein one player's objective is dependent upon the performance of the other player. Such games are possible because the targets 30 are monitored and serviced by the same microprocessor means. This allows the microprocessor means to assimilate data on both players performance and vary the functions of each target 30 accordingly.

I claim as my invention:

1. A multiple target electronic dart game, comprising in combination:

first target means including first dart hit detection means for detecting dart hits on the first target means;

second target means including second dart hit detection means for detecting dart hits on the second target means; and shared processor means for monitoring and servicing both the first and second target means.

2. The multiple target electronic dart game as set forth in claim 1, further comprising:

upright support means adapted to house the processor means, and the first and second target means are carried by the upright support means.

3. The multiple target electronic dart game as set forth in claim 2, wherein the upright support means is adapted to be floor-standing.

4. The multiple target electronic dart game as set forth in claim 2 wherein the upright support means includes:

a column to support the multiple target electronic dart game, and the first and second target means are affixed to opposite sides of the column.

5. The multiple target electronic dart game as set forth in claim 4, wherein a visual display means is affixed to the top of the column.

6. The multiple target electronic dart game as set forth in claim 1, further comprising:

visual display means for presentation of multiple target electronic dart game conditions.

7. The multiple target electronic dart game as set forth in claim 6, wherein the visual display means is carried by an upright support means.

8. The multiple target electronic dart game as set forth in claim 6 or 5, wherein the visual display means is a video monitor.

9. The multiple target electronic dart game as set forth in claim 8, wherein the visual display means is capable of split-screen presentation.

10. The multiple target electronic dart game as set forth in claim 1, further comprising:

a player interface enabling players to communicate with the processor means.

* * * * *

UNITED STATES PATENT AND TRADEMARK OFFICE

CERTIFICATE OF CORRECTION

PATENT NO. : 5,020,806

DATED : June 4, 1991

INVENTOR(S) : John Martin

It is certified that error appears in the above-identified patent and that said Letters Patent is hereby corrected as shown below:

Column 2, line 38 after the word "that" add --monitor--; and

Column 2, line 38 delete "services" and substitute therefor --service--.

Column 4, line 5 after "2" add --,--.

Signed and Sealed this

Twentieth Day of July, 1993

*Attest:*

*Attesting Officer*

Michael K. Kirk

MICHAEL K. KIRK

*Acting Commissioner of Patents and Trademarks*